US009663201B2

(12) United States Patent
Sim et al.

(10) Patent No.: US 9,663,201 B2
(45) Date of Patent: May 30, 2017

(54) CLEANING ROBOT

(71) Applicant: ROLLS-ROYCE PLC, London (GB)

(72) Inventors: Alastair Sim, Bristol (GB); Alexis Lambourne, Derby (GB)

(73) Assignee: ROLLS-ROYCE PLC, London (GB)

( * ) Notice: Subject to any disclaimer, the term of this patent is extended or adjusted under 35 U.S.C. 154(b) by 71 days.

(21) Appl. No.: 14/933,291

(22) Filed: Nov. 5, 2015

(65) Prior Publication Data

US 2016/0144936 A1 May 26, 2016

(51) Int. Cl.

| | |
|---|---|
| ***B08B 7/04*** | (2006.01) |
| ***B08B 1/00*** | (2006.01) |
| ***B63B 59/06*** | (2006.01) |
| ***B63B 59/10*** | (2006.01) |
| ***B63B 9/00*** | (2006.01) |

(52) U.S. Cl.

CPC ..... *B63B 59/06* (2013.01); *B08B 7/04* (2013.01); *B63B 9/00* (2013.01); *B63B 59/10* (2013.01); *B08B 1/006* (2013.01)

(58) Field of Classification Search

CPC ..... B63B 59/06; B63B 59/08; B63B 59/10; B63B 9/00; B08B 1/00; B08B 1/001; B08B 1/005; B08B 1/006; B08B 7/04

See application file for complete search history.

(56) References Cited

U.S. PATENT DOCUMENTS

| | | | | |
|---|---|---|---|---|
| 9,051,028 | B2 * | 6/2015 | Smith | B63B 59/10 |
| 2008/0302024 | A1 * | 12/2008 | Browne | E04B 1/00 52/1 |
| 2010/0126403 | A1 | 5/2010 | Rooney, III et al. | |
| 2010/0131098 | A1 | 5/2010 | Rooney, III et al. | |
| 2013/0248024 | A1 * | 9/2013 | Dunn | G01L 9/0072 137/551 |

FOREIGN PATENT DOCUMENTS

| | | | |
|---|---|---|---|
| GB | 2103162 | A | 2/1983 |
| WO | 2014/043411 | A1 | 3/2014 |

OTHER PUBLICATIONS

Apr. 15, 2016 Search Report issued in European Patent Application No. 15192962.

Apr. 29, 2015 Search Report issued in British Patent Application No. 1420918.3.

Bar-Cohen et al., "Electroactive Polymer Actuators and Sensors", MRS Bulletin, vol. 33, 2008, pp. 173-181.

Cheng et al., "Field-Actived Electroactive Polymers", MRS Bulletin, vol. 33, 2008, pp. 183-187.

* cited by examiner

*Primary Examiner* — Saeed T Chaudhry

(74) *Attorney, Agent, or Firm* — Oliff PLC

(57) ABSTRACT

A robot for cleaning submersed marine structures is provided. The robot has a drive system for traversing the robot over the submersed structure. The robot further has an attachment system for attaching the robot to the submersed structure. The robot further has a cleaning arrangement for removing biofouling from the submersed structure as the robot is traversed thereover. The robot further has one or more flexible detector strips which contact the submersed structure as the robot is traversed thereover. The strips have a plurality of electrodes and are formed from electroactive polymer material which produces electrical signals in the electrodes on deflection of the strips. The signals are indicative of the surface roughness of the submersed structure.

15 Claims, 4 Drawing Sheets

CLEANING ROBOT

FIELD OF THE INVENTION

The present invention relates to robot for cleaning submersed marine structures, such as ship's hulls.

BACKGROUND OF THE INVENTION

Biofouling is the growth of marine organisms on a structure. Biofouling includes a nucleation stage comprising a microbiological slime, and a subsequent growth stage of hard fouling comprising seaweed, barnacles, limpets, mussels, etc. The build-up of biofouling is of concern as it increases vessel hull drag (and associated fuel burn and emissions). There is also environmental concern about transportion and of release of marine invasive species through shedding of fouling (whether accidently or through cleaning). FIG. 1 shows a ship's hull with heavy hard biofouling.

For many years the control of biofouling on vessels was achieved using biocide paints containing copper compounds or tributyltin (TBT) which kill organisms and spores, preventing attachment and growth of a biofilm. TBT paints have now been shown to be environmentally damaging and are being progressively banned and phased out. Some "self-polishing" paints contain different biocide compounds, but these are also under increasing environmental scrutiny.

Fouling release paints (FRPs) use a range of low surface energy polymers (sometimes in combination with micro or nano textures) to make it difficult for organisms to attach securely to a vessel's hull. As the organism grows, the hydrodynamic drag force acting on it overcomes the adhesion strength and the organism is pulled off the hull by the flow of water over it. However, FRPs require fouling to build up to a certain level before it can be shed. As a result, FRPs incur an increased drag penalty relative to a hull with no fouling. FRPs also do not address the issue of transportation of invasive species.

Heavy fouling can be removed by sending divers down with cleaning equipment to detach the fouling from the hull. However, the process is slow and costly. Further, poor visibility under water may cause the divers to damage paint or miss areas, resulting in patchy cleaning. In addition, not all ports allow diver cleaning, as the organisms removed by such cleaning are released and may constitute invasive species.

Recently robotic cleaning devices have been developed to remove fouling from the hull. Most include brushes or scouring pads to remove hard fouling, although such aggressive cleaning approaches can damage paint and initiate corrosion. The robots are typically deployed while the ship is stationary.

SUMMARY OF THE INVENTION

In a first aspect, the present invention provides a robot for cleaning submersed marine structures, the robot having:

- a drive system for traversing the robot over the submersed structure;
- an attachment system for attaching the robot to the submersed structure; and
- a cleaning arrangement for removing biofouling from the submersed structure as the robot is traversed thereover;
- wherein the robot further has one or more flexible detector strips which contact the submersed structure as the robot is traversed thereover, the strips having a plurality of electrodes and being formed from electroactive polymer material which produces electrical signals in the electrodes on deflection of the strips, the signals being indicative of the surface roughness of the submersed structure.

By detecting regions of surface roughness on the structure via the electrical signals, the robot thus enables an efficient two stage cleaning process, the first stage being performed by the cleaning arrangement of the robot as it is traversed over the structure, and the second being performed after the traversal to remove any remaining hard fouling at the detected regions. For example, the second stage can be performed by localised diver cleaning.

Indeed, in a second aspect, the present invention provides a method of cleaning a submersed marine structure including:

- traversing the robot of any one of the previous claims over the submersed structure to remove biofouling therefrom and to detect regions of surface roughness of the submersed structure; and
- performing hard fouling cleaning at the detected regions.

Optional features of the invention will now be set out. These are applicable singly or in any combination with any aspect of the invention.

The submersed structure may be a ship's hull. Alternatively, however, it can be static installation, such as an oil or gas platform, off-shore wind turbine, tidal turbine, or a pipeline.

Preferably, the cleaning arrangement includes a squeegee scraper which removes microbiological sliming from the submersed structure. By using the robot to remove microbiological sliming, the build-up of hard fouling can be substantially prevented, any regions of hard fouling that do occur being detected by the detector strips. Advantageously, the squeegee scraper can be non-aggressive, unlike brushes or scouring pads, and thus it can avoid damage to paint. In other words, such a scraper is compatible with a range of submersed structure coatings and paint systems. The robot encourages regular, frequent removal of biofilm sliming, helping to prevent hard fouling taking hold and maintaining optimum vessel efficiency over long periods of operation. The squeegee scraper can be multi-layered including e.g. layers of sponge, rubber and/or other compliant material. The squeegee scraper may form a skirt around the robot. Such an arrangement can spread robot contact loads on the submersed structure as well as providing efficient cleaning.

Additionally or alternatively, the cleaning arrangement can include one or more water jets and/or one or more electrochlorination devices.

The detector strip(s) may extend in a substantially continuous line across the width of the robot. For example, the robot may have a single strip extending across the width with the plurality of electrodes arranged along the strip, or it may have a line of side-by-side strips, each with a respective pair of electrodes.

The detector strip(s) may form a skirt around the robot. For example, if the cleaning arrangement includes a squeegee scraper formed as a skirt around the robot, the detector strip(s) can form a second skirt, which is typically inside the squeegee scraper skirt.

Conveniently, the drive system may include two or more continuous tracks. Such tracks can reduce contact pressure on the submersed structure. The robot can be steerable by differential movement of the tracks. Further, the tracks can be positioned to give a small turning radius for the robot.

The attachment system may include one or more electromagnets. Such magnets can be switched off when the robot needs to be removed from submersed structure, allowing rapid retrieval. The robot can have non-abrasive spacers or rollers to maintain the electromagnets at a predetermined distance from the submersed structure.

The robot may further have an umbilical. For example, the umbilical can supply power to the robot, transmit control signals to the robot and/or transmit the detector strip electrical signals from the robot. More particularly, such an umbilical can be attached to the ship's deck and thereby provide the robot with power from an on-board power supply or generator. Using an umbilical to provide power means that the robot is not dependant on on-board batteries or built-in generators, which can be vulnerable to biofouling. Reducing equipment on the robot also allows the robot geometry to be made more streamlined, decreasing drag. The umbilical can double as a recovery tether for retrieval of the robot.

The robot can have a control unit. This can be a part of the robot which, in use, is attached to the submersed structure (i.e. so that the robot can be autonomous). Another option, however, is for the control unit to be a deck-located accessory, which can enable an operator interface and manual control.

The robot may further have a substantially conical or pyramidal housing, the base of the cone or pyramid being, in use, proximal the submersed structure. Such a hydrodynamic shape can allow the robot to be used while the ship is in transit. In particular, the housing can have an internal angle at the base of the cone/pyramid which is, for example, at most 25° and/or at least 5°, the actual angle being selected dependant on robot diameter and vessel speed. Typically, for a robot of about 1.5 m diameter operating at a vessel speed of about 15 knots, the internal angle at the base of the housing can be about 8°.

The housing may be formed as a plurality of articulated housing sections which allow the robot to accommodate curvature of the submersed structure.

The height of the housing can be controllably varied. This can help to maintain a hydrodynamic shape for the robot The robot may further have a logging unit which receives the signals produced by the detector strips and correlates the signals to the robot's position on the submersed structure. The logging unit can be housed within a body of the robot, or it can be remote from the robot, in which case it can be attached by the aforementioned umbilical. The logging unit can be a part of the aforementioned control unit.

The robot may further have a ballast tank. This can be used to make the robot neutrally buoyant during operation and to float the robot when it needs to be recovered.

BRIEF DESCRIPTION OF THE DRAWINGS

Embodiments of the invention will now be described by way of example with reference to the accompanying drawings in which:

FIG. 5(*b*) shows a top view of a pyramid robot, with lines of articulation between housing sections being indicated by dotted lines;

FIG. 7(*b*) shows a row of discrete strips, each with its own pair of electrodes;

FIG. 8(*b*) shows schematically a robot detector strip arrangement in which a skirt is formed from a row of detector strips, FIG. 8(*c*) shows schematically a robot detector strip arrangement in which a width-wise straight line is formed from a row of detector strips; and FIG. 8(*d*) shows schematically a robot detector strip arrangement in which a width-wise curved line is formed from a row of detector strips.

DETAILED DESCRIPTION AND FURTHER OPTIONAL FEATURES OF THE INVENTION

Figure 1:
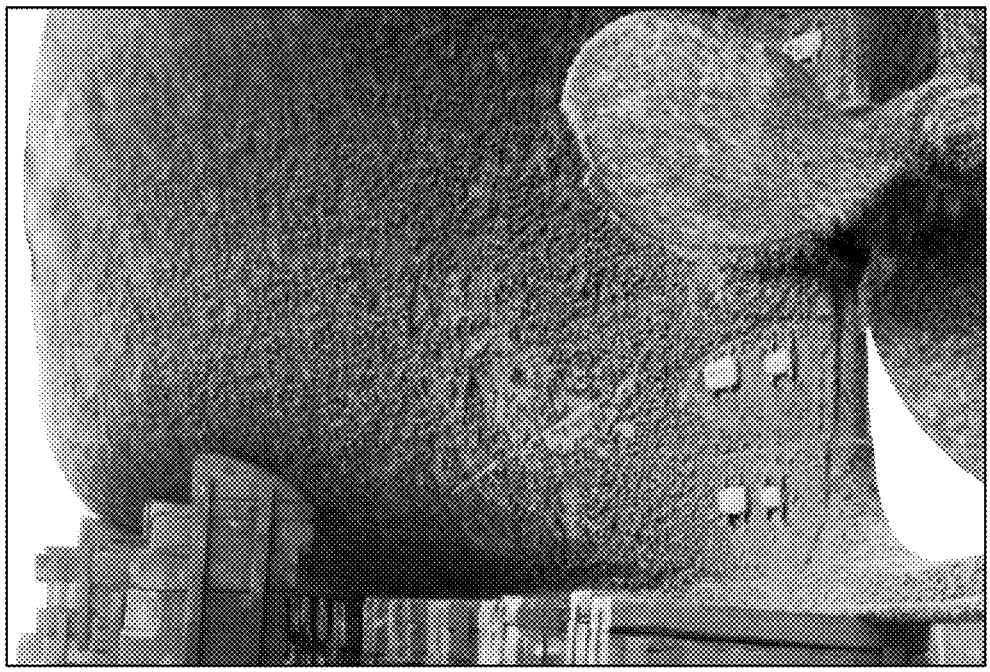
FIG. 1 shows a ship's hull with heavy hard biofouling.
Figure 2:
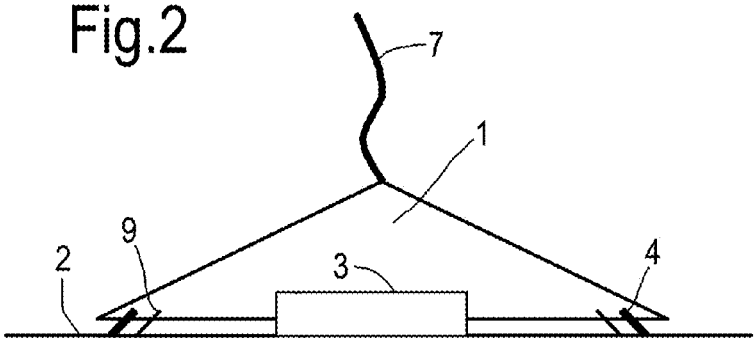
FIG. 2 shows schematically a side view of a robot according to the present invention.
Figure 3:
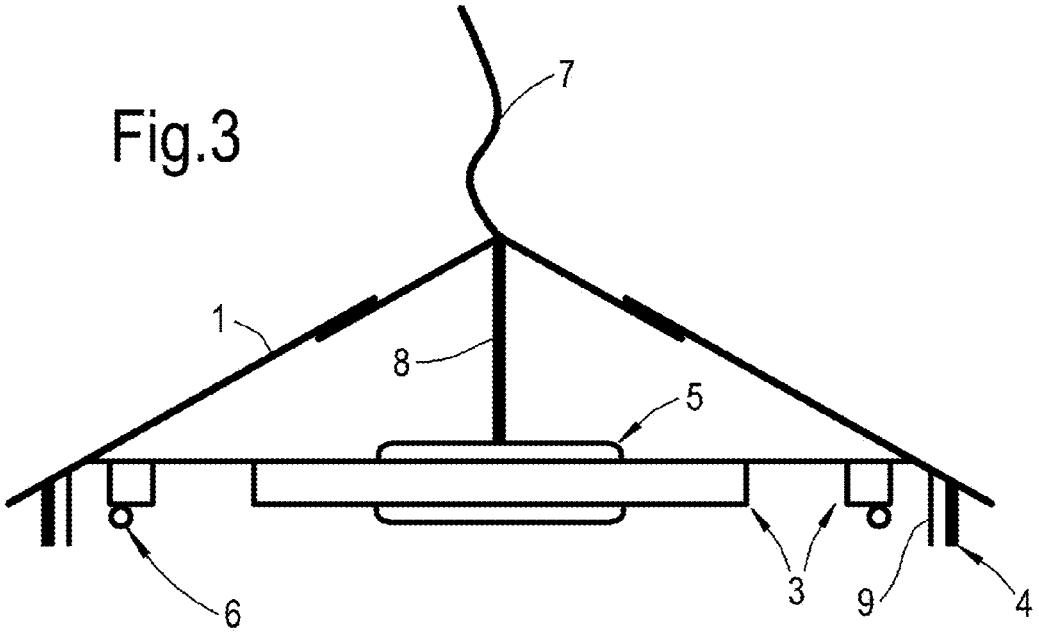
FIG. 3 shows schematically a cross-section view through the robot of FIG. 2.
Figure 4:
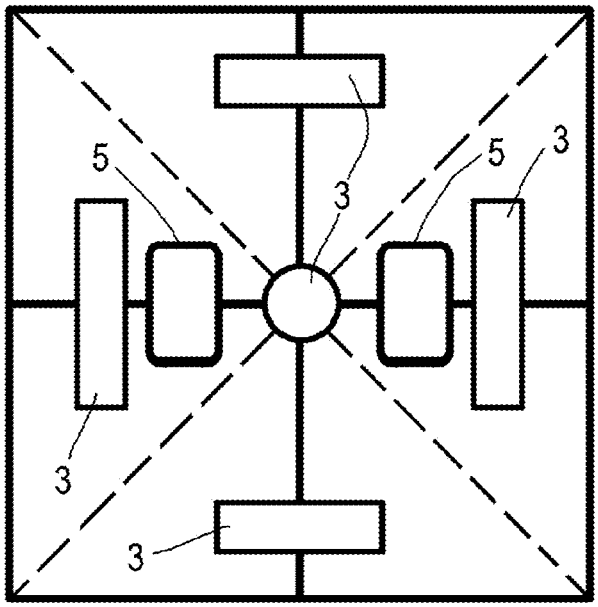
FIG. 4 shows schematically a bottom view of the robot of FIG. 2.

FIGS. 2 to 4 show schematically side, cross-section and bottom views of a robot according to the present invention. The robot has a housing 1 formed in the shape of a shallow pyramid. The base of the pyramid is located on the surface of the hull 2 of a vessel. Although depicted as a four-sided, square-based pyramid, other base configurations and numbers of sides can be used, or the housing 1 can be conical rather than pyramidal.

The housing 1 has a small internal angle at its base. This shape reduces drag forces imposed on the robot and allows the robot to be deployed while the vessel is moving, reducing the impact of the robot on the operational profile of the vessel. This approach also allows regular, frequent removal of biofilm from the hull 2, preventing hard-fouling from establishing, and helping to maintain optimum vessel efficiency over long periods of operation.

For example, the internal angle at the base of the housing can be in the range 5 to 25°, dependant on robot diameter and vessel speed. Typically for a robot of about 1.5 m diameter operating at a vessel speed of 15 knots the internal angle of the base of the housing can be about 8°.

The robot is adhered to the hull by electromagnets 3. These spread the contact load and allow the robot to work with a range of paint systems. Removal of the biofilm is achieved by a squeegee scraper skirt 4 mounted on the periphery of the robot. The skirt provides additional area for spreading the contact load, and allows the robot to work with a range of hull coatings and paint systems. The skirt comprises one or more layers of sponge, rubber or other compliant material. Additionally or alternatively, the robot may house one or more water jets, or be used to direct a waterjet.

Propulsion is provided by a pair of centrally-located continuous tracks 5. The tracks are sized to lower contact pressure, thereby reducing or preventing damage to paint. Steering can be achieved using differential movement of the tracks, which can be positioned to provide a small turning radius.

One of the electromagnets 3 is located centrally between the tracks 5, and the other electromagnets surround the tracks. Non-abrasive spacers or rollers 6 on the undersides of the surrounding electromagnets maintain a set distance between the hull and the robot in order to apply the correct degree of compression in the squeegee skirt 4. The electromagnets can be switched off when robot needs to be removed from hull, allowing rapid retrieval. Electromagnets providing around 400 Gauss can provide sufficient adhesion for a robot of about 1.5 m diameter.

Figure 5A:
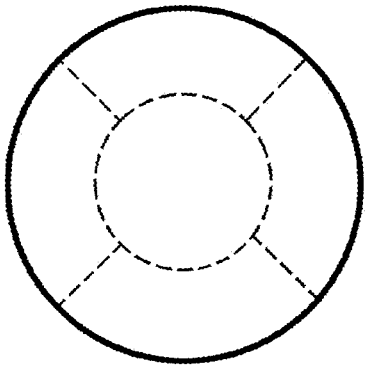
FIG. 5(*a*) shows a top view of a conical robot, with lines of articulation between housing sections being indicated by dotted lines.
Figure 5B:
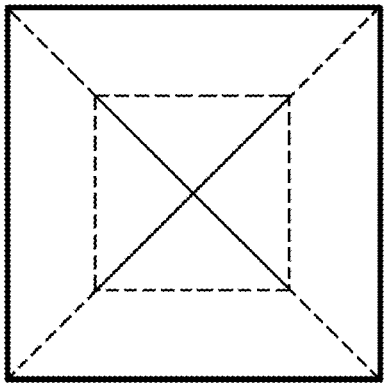

In order to accommodate the curvature of the hull, the housing can be formed as a number of articulated sections. For example, FIG. 5 shows top views of (a) a conical robot and (b) a pyramidal robot, with lines of articulation between housing sections indicated by dotted lines. The squeegee skirt 4 can adapt to the relative movement of the sections and conform to the contours of the hull. To further enhance this adaptation, the skirt may be dis-continuous around perimeter, e.g. with different articulated sections carrying respective skirt portions which overlap with adjacent portions to ensure no gaps form in the skirt as the sections articulate.

To maintain a hydrodynamic shape, the height of robot can be variable. This can be achieved, for example, by a central, telescopic and spring-loaded column 8. Changing the height of the robot also helps the robot to conform to the radius of curvature of the hull.

The robot has an umbilical 7 which extends to the ship's deck so that the robot can use an on-board power supply or generator. This can provide AC or DC power and the umbilical 7 can double as a recovery tether/cable for retrieval of the robot. Using an umbilical to provide power allows the robot to be independent from on-board batteries or built-in generators, which can be vulnerable to biofouling. Reducing the amount of equipment on the robot also facilitates a more streamlined housing geometry.

The robot can be pre-programmed to follow a route along the hull. For example, the robot can contain a control unit loaded with a CAD model of the hull and with a datum point provided by an RFID tag at the point of deployment from the vessel deck. In another example, the robot control unit can be on deck, and control signals sent to the robot over the umbilical 7. This also provide an option of manual control of the robot.

The robot can be equipped with an electrochlorination device to provide spot cleaning capability, and in particular to enable cleaning of small recesses and grooves not accessible by the skirt 4.

The robot can be fitted with a ballast tank to make the robot neutrally buoyant during operation and float the robot when it needs to be recovered.

Advantageously, the robot can sense the surface roughness of the hull 2 as the robot passes over it. This can provide information on the location and severity of hard fouling, which can then guide divers to these small areas for additional spot cleaning. Further, the information can be used as proof of a clean hull for entry into territorial waters with invasive species transport restrictions (e.g. Australia). The information can also give an indication about development of corrosion deposits or coating failure from raised rust.

More particularly, the robot uses an electroactive polymer (EAP) as a sensor. In such a polymer, an externally applied force can induce a voltage. Yoseph Bar-Cohen 2011, *Electroactive Polymer Actuators and Sensors*, MRS Bulletin, Volume 33, Issue 3, March 2008, pp 173-181, doi: 10.1557/mrs2008.42, Published online by Cambridge University Press 31 Jan. 2011 and Zhongyang Cheng 2011, *Field-Activated Electroactive Polymers*, MRS Bulletin, Volume 33, Issue 3, March 2008, pp 183-187, doi: 10.1557/mrs2008.43, Published online by Cambridge University Press 31 Jan. 2011 reference some of the types of EAP and their applications as sensors and actuators.

Figure 6:
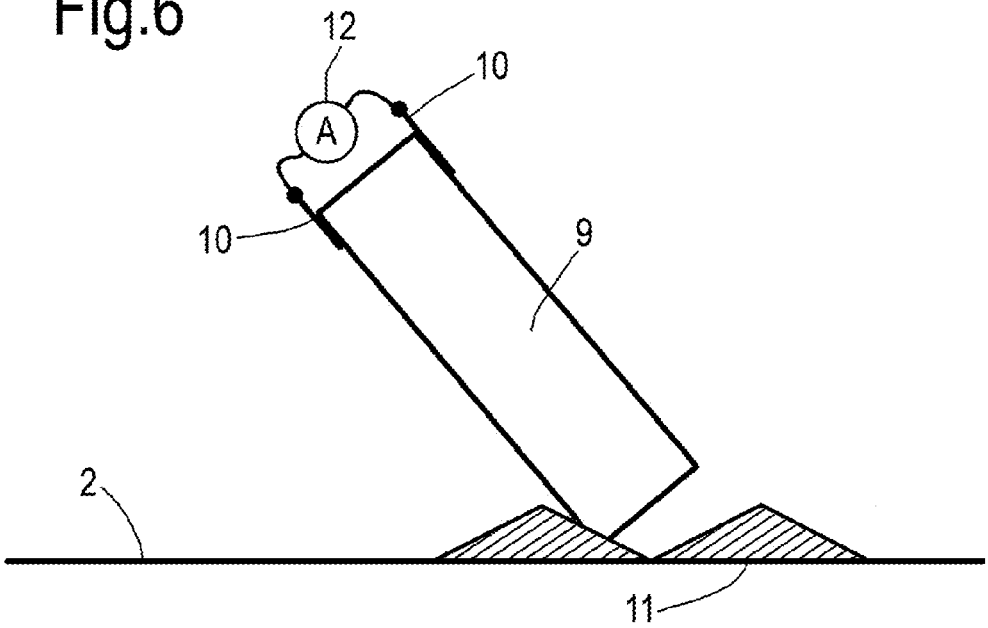
FIG. 6 shows schematically the operation of an electroactive polymer detector strip.

In the robot of FIGS. 2 to 4, an EAP detector strip 9 forms a skirt around the robot within the squeegee scraper skirt 4. The EAP strip is deflected, as shown in FIG. 6, when the strip passes over an area of surface roughness 11, which can be hard fouling (e.g. barnacles, limpets) or damage (e.g. corrosion, rust, paint blistering). The deformation of the EAP material induces a small voltage indicating the magnitude of the roughness. The strip 9 has positive and negative electrodes 10 which deliver the generated current to sensing electronics 12.

The EAP detector strip 9 can be correlated with navigation data used to operate the robot around the hull 2. For example, the combination of EAP detector data and 3D geometry data from the hull can identify the location and magnitude of hard fouling. The correlation of the data can be performed by a logging unit, which may be part of robot, or on board deck, in which case the data can be transmitted to the unit via the umbilical 7. When hard fouling is identified, mitigating action can then be taken, e.g. localised diver cleaning and intervention.

The EAP material can be, for example vinylidene flouride (VDF), trifluoroethylene (TrFE), chlorofluoroethylene (CFE), chlorotrifluoroethylene (CFE), hexafluoropropylene (HFP), nylon 9, nylon 11, or any other odd number trans nylon.

Figure 7A:
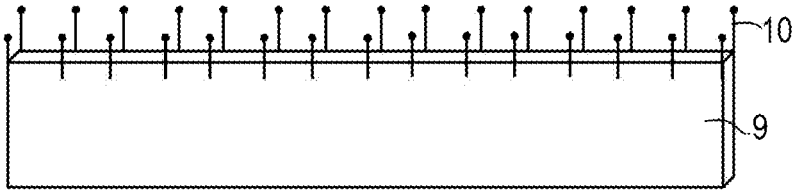
FIG. 7(*a*) shows schematically a continuous detector strip with rows of electrodes.
Figure 7B:
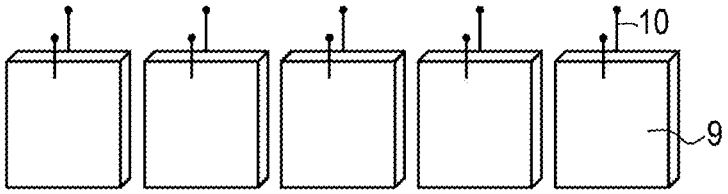
Figure 8A:
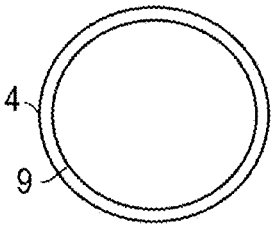
FIG. 8(*a*) shows schematically a robot detector strip arrangement in which a skirt is formed from a single detector strip.
Figure 8B:
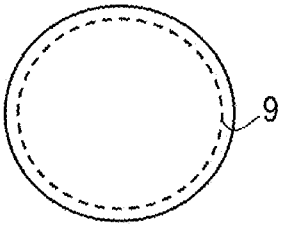
Figure 8C:
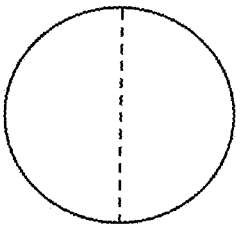
Figure 8D:
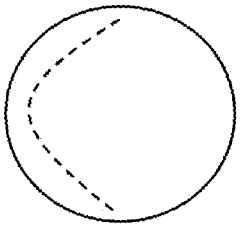

The robot may have a single EAP strip with rows of electrodes, as shown in FIG. 7(*a*), or a row of discrete strips, each with its own pair of electrodes, as shown in FIG. 7(*b*).

The detector strip(s) 9 may be arranged in the robot in a number of ways. For example, the strip(s) may form a skirt around the robot as shown in FIGS. 2 to 4. Such a skirt can be formed from a single strip, as illustrated in FIG. 8(*a*) or plural strips, as illustrated in FIG. 8(*b*). Instead of a skirt, however, another option is to form the strip(s) as a continuous straight or curved line across the width of the robot as illustrated in FIGS. 8(*c*) and (*d*).

Advantageously, the EAP material can provide a simple, robust, sub-sea detector which can be readily integrated into the hull cleaning robot and used to guide subsequent hard fouling cleaning.

While the invention has been described in conjunction with the exemplary embodiments described above, many equivalent modifications and variations will be apparent to those skilled in the art when given this disclosure. For example, the electromagnet can be replaced with an attachment system based on high pressure suction provided by a pump. However, in this case, the housing should be sufficiently water tight to allow an adequate pressure difference between the inside and outside of robot to be established. As another example, the robot can be used to clean other types of submersed marine structures, such as static installations. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A hull cleaning robot for cleaning submersed marine structures, the robot having:

a drive system for traversing the robot over the submersed structure;

an attachment system for attaching the robot to the submersed structure; and a cleaning arrangement for removing biofouling from the submersed structure as the robot is traversed thereover;

wherein the robot further has one or more flexible detector strips which contact the submersed structure as the robot is traversed thereover, the strips having a plurality of electrodes and being formed from electroactive polymer material which produces electrical signals in the electrodes on deflection of the strips, the signals being indicative of the surface roughness of the submersed structure.

2. A robot according to claim 1, wherein the cleaning arrangement includes a squeegee scraper which removes microbiological sliming from the submersed structure.

3. A robot according to claim 1, wherein the squeegee scraper forms a skirt around the robot.

4. A robot according to claim 1, wherein the detector strips extend in a substantially continuous line across the width of the robot.

5. A robot according to claim 1, wherein the detector strips form a skirt around the robot.

6. A robot according to claim 1, wherein the drive system includes two or more continuous tracks.

7. A robot according to claim 6, wherein the robot is steerable by differential movement of the tracks.

8. A robot according to claim 1, wherein the attachment system includes one or more electromagnets.

9. A robot according to claim 1, further having an umbilical.

10. A robot according to claim 1, further having a substantially conical or pyramidal housing, the base of the cone or pyramid being proximal the submersed structure.

11. A robot according to claim 10, wherein the housing is formed as a plurality of articulated housing sections which allow the robot to accommodate curvature of the submersed structure.

12. A robot according to claim 10, wherein the height of the housing is controllably variable.

13. A robot according to claim 1, further having a logging unit which receives the signals produced by the detector strips and correlates the signals to the robot's position on the submersed structure.

14. A robot according to claim 1, further having a ballast tank.

15. A method of cleaning a submersed structure including:

traversing the robot of claim 1 over the submersed structure to remove biofouling therefrom and to detect regions of surface roughness of the submersed structure; and performing hard fouling cleaning at the detected regions.

* * * * *